US007950498B2

(12) United States Patent
Yang et al.

(10) Patent No.: US 7,950,498 B2
(45) Date of Patent: May 31, 2011

(54) STAIR CLIMBING AID

(75) Inventors: Jiin-Hwa Yang, Nantou County (TW); Hui-Li Weng, Nantou County (TW)

(73) Assignee: Nan Kai Institute of Technology, Nantou County (TW)

( * ) Notice: Subject to any disclaimer, the term of this patent is extended or adjusted under 35 U.S.C. 154(b) by 583 days.

(21) Appl. No.: 12/108,690

(22) Filed: Apr. 24, 2008

(65) Prior Publication Data

US 2008/0264722 A1 Oct. 30, 2008

(30) Foreign Application Priority Data

Apr. 27, 2007 (TW) ..... 96115083 A
Apr. 30, 2007 (TW) ..... 96206914 U

(51) Int. Cl.
*E04G 27/00* (2006.01)

(52) U.S. Cl. ..... 182/206; 182/230; 52/174; 52/184; 52/29

(58) Field of Classification Search ..... 182/106, 182/230; 52/174, 184, 29
See application file for complete search history.

(56) References Cited

U.S. PATENT DOCUMENTS

| | | | | | |
|---|---|---|---|---|---|
| 1,785,487 | A * | 12/1930 | McAvoy | 49/70 |
| 3,121,476 | A * | 2/1964 | Mazzarelli | 187/201 |
| 4,046,226 | A * | 9/1977 | Flinchbaugh | 187/202 |
| 4,253,287 | A * | 3/1981 | Overmoe | 52/184 |
| 4,438,830 | A * | 3/1984 | Born | 187/201 |
| 4,823,524 | A * | 4/1989 | Bednar | 52/182 |
| 4,899,989 | A * | 2/1990 | Kitson et al. | 256/1 |
| 5,022,197 | A * | 6/1991 | Aragona | 52/29 |
| 5,269,227 | A * | 12/1993 | Warren et al. | 105/29.1 |
| 5,363,771 | A * | 11/1994 | Warren et al. | 105/29.1 |
| 5,522,322 | A * | 6/1996 | Warren et al. | 105/29.1 |
| 7,185,741 | B1 * | 3/2007 | Rozenfeld | 187/200 |
| 7,537,069 | B2 * | 5/2009 | Kramer et al. | 180/65.1 |
| 7,870,695 | B2 * | 1/2011 | Manson et al. | 52/184 |
| 2003/0079417 | A1 * | 5/2003 | Bonin | 52/29 |
| 2008/0093176 | A1 * | 4/2008 | Rosenthal | 187/241 |

* cited by examiner

*Primary Examiner* — Katherine Mitchell
*Assistant Examiner* — Daniel Cahn

(57) ABSTRACT

A stair climbing aid comprises two slide rails, an assist member, a control mechanism and two positioning assemblies. The slide rails and the assist member are assembled to handrails at both sides of the stairs. The control mechanism is disposed on the assist member to be controlled by the user. The positioning assemblies are disposed at both sides of the assist member, each positioning assembly is provided with an engaging portion to be engaged in the respective positioning portions of the slide rail. Thereby, an anti-slide effect is produced, so as to prevent the user from falling down the stairs and to help the user move from step to step safely.

4 Claims, 14 Drawing Sheets

STAIR CLIMBING AID

BACKGROUND OF THE INVENTION

1. Field of the Invention

The present invention relates to a stair climbing aid, and more particularly to a stair climbing aid which assists physically impaired people in climbing up and down stairs independently and easily.

2. Description of the Prior Art

Climbing stairs is an easy thing for a healthy person, but it is a big problem for a physically impaired or an aged person. This problem is becoming even worse since today the number of the aged people is increasing and the buildings are also becoming more and more high. Although elevator or escalator can be used to facilitate access to different floors, not every building is suitable to have an elevator or escalator. In addition, elevator or escalator not only is expensive but also requires a large installation space, not any family can afford it. Therefore, many physically impaired or aged people have to move sideways by grasping one handrail with one hand or move up slowly by grasping two handrails with both hands and slide their hands, and there is no support or protection device in front of the climber. The climber's safety solely relies on his arm strength, the accident of falling off the stairs often occurs.

The present invention has arisen to mitigate and/or obviate the afore-described disadvantages.

SUMMARY OF THE INVENTION

The present invention is to provide a stair climbing aid which assists physically impaired people, such as a patient and an aged person, in climbing up and down stairs, and is affordable for any family since it is inexpensive and occupies a small installation space.

Requiring only a small or even no electric power, the stair climbing aid allows the user to climb up and down stairs safely with his arm strength.

To achieve the above objective, the present invention provides a stair climbing aid which is an assist member capable of sliding along two handrails of the stairs and comprises:

two slide rails assembled to both sides of the stairs, each slide rail is defined with a slide groove in an inner side thereof and is provided with a plurality of positioning portions, the slide grooves are opposite to each other;

an assist member, both ends of the assist member are slidably received in the slide grooves of the slide rails;

a control mechanism disposed on the assist member to be controlled by the user; and two positioning assemblies, each positioning assembly is provided with a spring, a connecting portion and an engaging portion, the spring is biased between the connecting portion and the engaging portion, the engaging portion is pushed by the spring to protrude out of one side of the assist member and is connected to the control mechanism by a connecting member.

Therefore, the stair climbing aid of the present invention can assist the user in climbing up and down stairs and has an anti-slide effect, so as to prevent the user from falling down the stairs and to help the user move from step to step safely.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
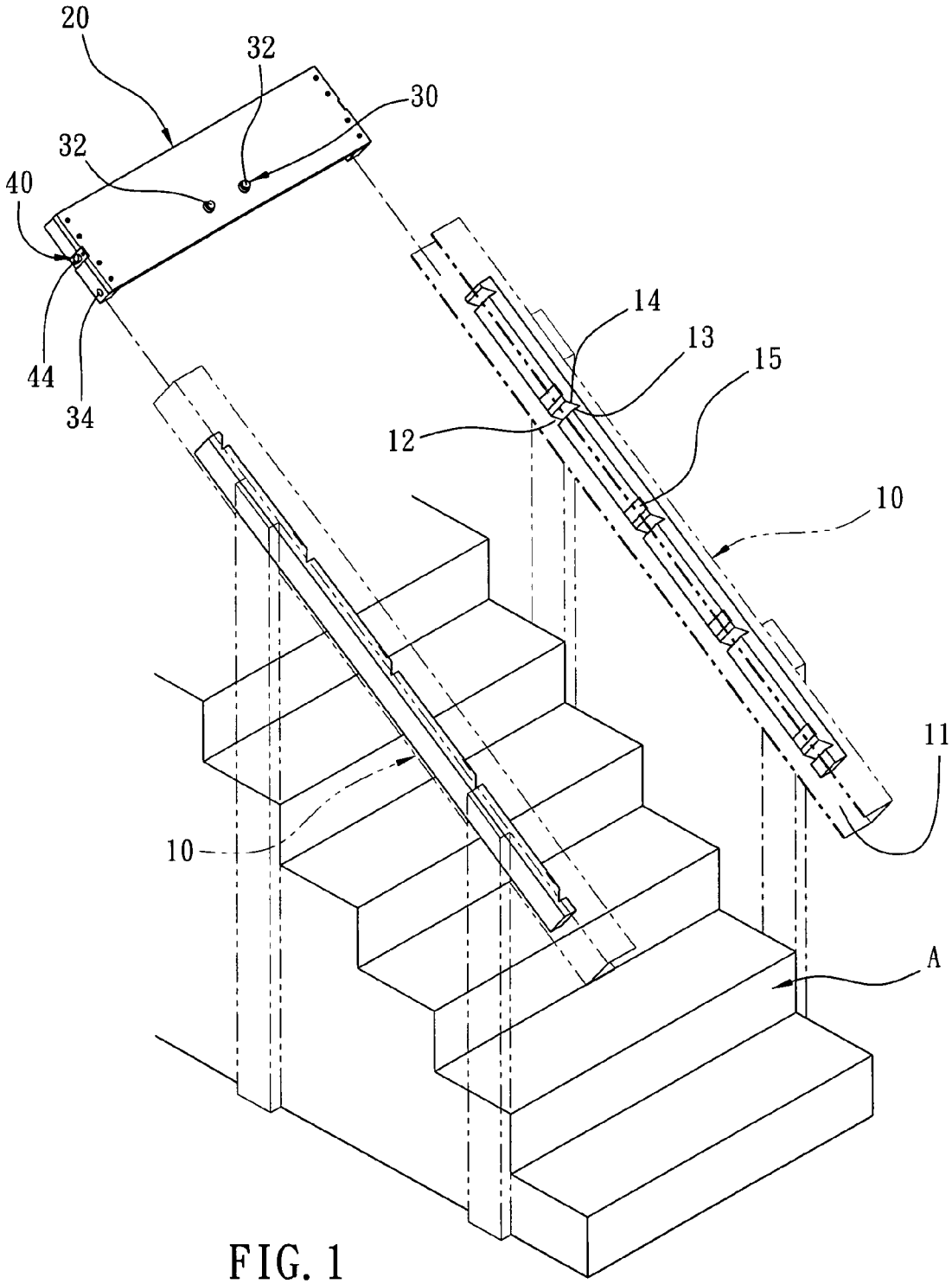
FIG. 1 is a perspective view of a stair climbing aid in accordance with a first embodiment of the present invention.

Referring to FIG. 1, a stair climbing aid in accordance with the present invention is assembled to stairs A and comprises two slide rails 10, an assist member 20, a control mechanism 30 and two positioning assemblies 40.

The slide rails 10 are assembled to both sides of the stairs A at an inclined angle (in this embodiment, they are assembled to the handrails at both sides of the stairs A by nails, bolts, screws, adhesive agent and so on). Each slide rail 10 is defined with a slide groove 11 in an inner side thereof and is provided with a plurality of positioning portions 12 in the form of an undercut (the positioning portion 12 can also be a groove, a hole or a cavity), and the slide grooves 11 are opposite to each other. Each positioning portion 12 is ∠-shaped, and is formed with a bottom surface 13 and a top surface 14. The bottom surface 13 is vertical to the extension direction of the slide rail 10. A induction member 15 is fixed adjacent to each positioning portion 12 by nails, bolts, screws, adhesive agent and so on, and the induction members 15 are disposed in the same direction.

Figure 2:
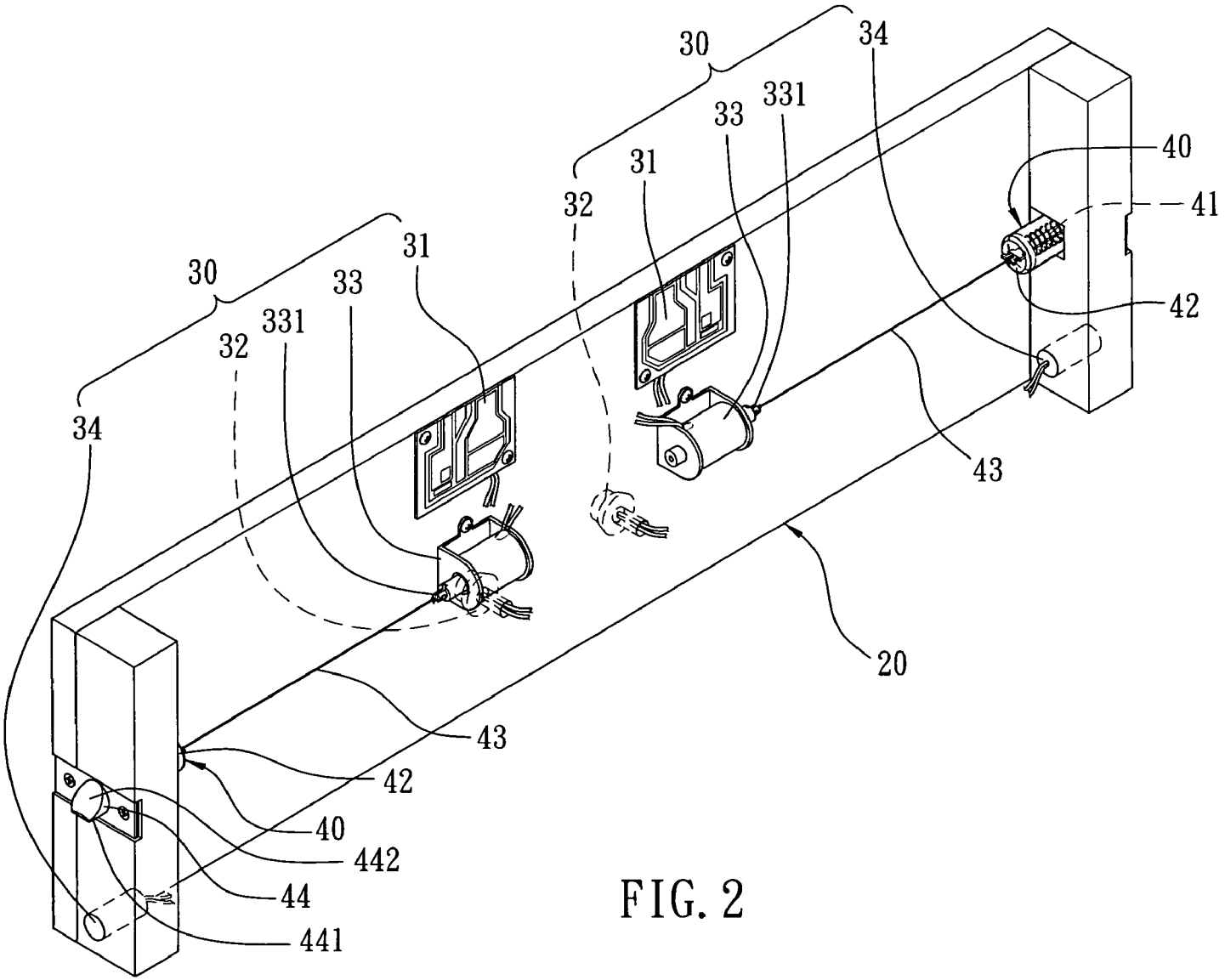
FIG. 2 is a perspective view of an assist member and a control mechanism in accordance with the first embodiment of the present invention.

Referring to FIGS. 1 and 2, both ends of the assist member 20 are slidably received in the slide grooves 11 of the slide rails 10.

Referring to FIG. 2, the control mechanism 30 is disposed on the assist member 20 and comprises two control circuits 31, two buttons 32, two electro-magnets 33 and two sensors 34, all the members of the control mechanism 30 are symmetrically disposed (and can be inlayed in or assembled to the assist member 20 by nails, bolts, screws, adhesive agent and so on). The buttons 32 are connected to their corresponding control circuits 31 and electro-magnets 33. One of the electro-magnets 33 is inserted with a driving rod 331 that is protruded out of one side of the electro-magnet 33. After being electrified, the electro-magnet 33 will drive the driving rod 331 to make one end of the driving rod 331 extend out of the electro-magnet 33, and the sensors 34 cooperate with the induction members 15 that are used to sense the slide rails 10 to carry out sensing operation (the sensing mode can be metal sensing, RFID sensing, magnetic sensing, infrared sensing and so on). The control circuits 31 are connected to a power source and each is electrically connected to its corresponding button 32, electro-magnet 33 and sensor 34 (in this embodiment, the control circuit 31, the button 32, the electro-magnet 33 and the sensor 34 are connected by a wire or are wirelessly connected). The electro-magnets 33 are connected to their corresponding positioning assemblies 40 by the driving rods 331.

Referring to FIG. 2 again, each positioning assembly 40 is provided with a spring 41, a connecting portion 42 and an engaging portion 44. The spring 41 is biased between the connecting portion 42 and the engaging portion 44. The engaging portion 44 is pushed by the spring 41 to protrude out of one side of the assist member 20 and is connected to the driving rod 331 of the control mechanism 30 by a connecting member 43 (in this embodiment, the connecting member 43 is a rope and can also be a string, a line, a thread, a chain, or a cable as long as it is strong enough to bear the driving force). The engaging portion 44 is ∠-shaped, and comprises an engaging surface 441 and a sliding surface 442. The engaging portion 44 cooperates with the positioning portion 12 to perform a telescopic movement.

Figure 3:
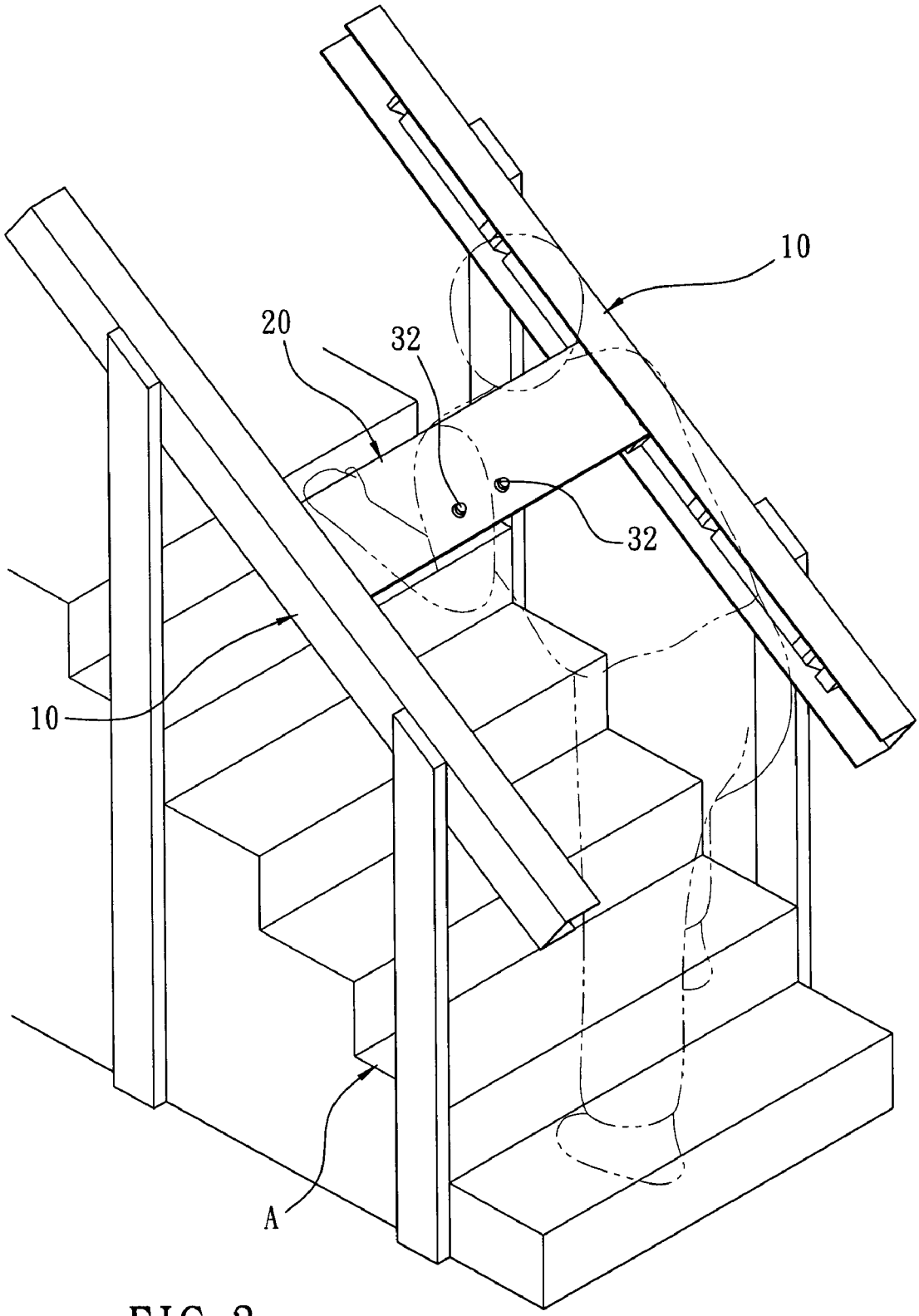
FIG. 3 is an illustrative view showing a state of climbing up stairs in accordance with the first embodiment of the present invention.
Figure 4:
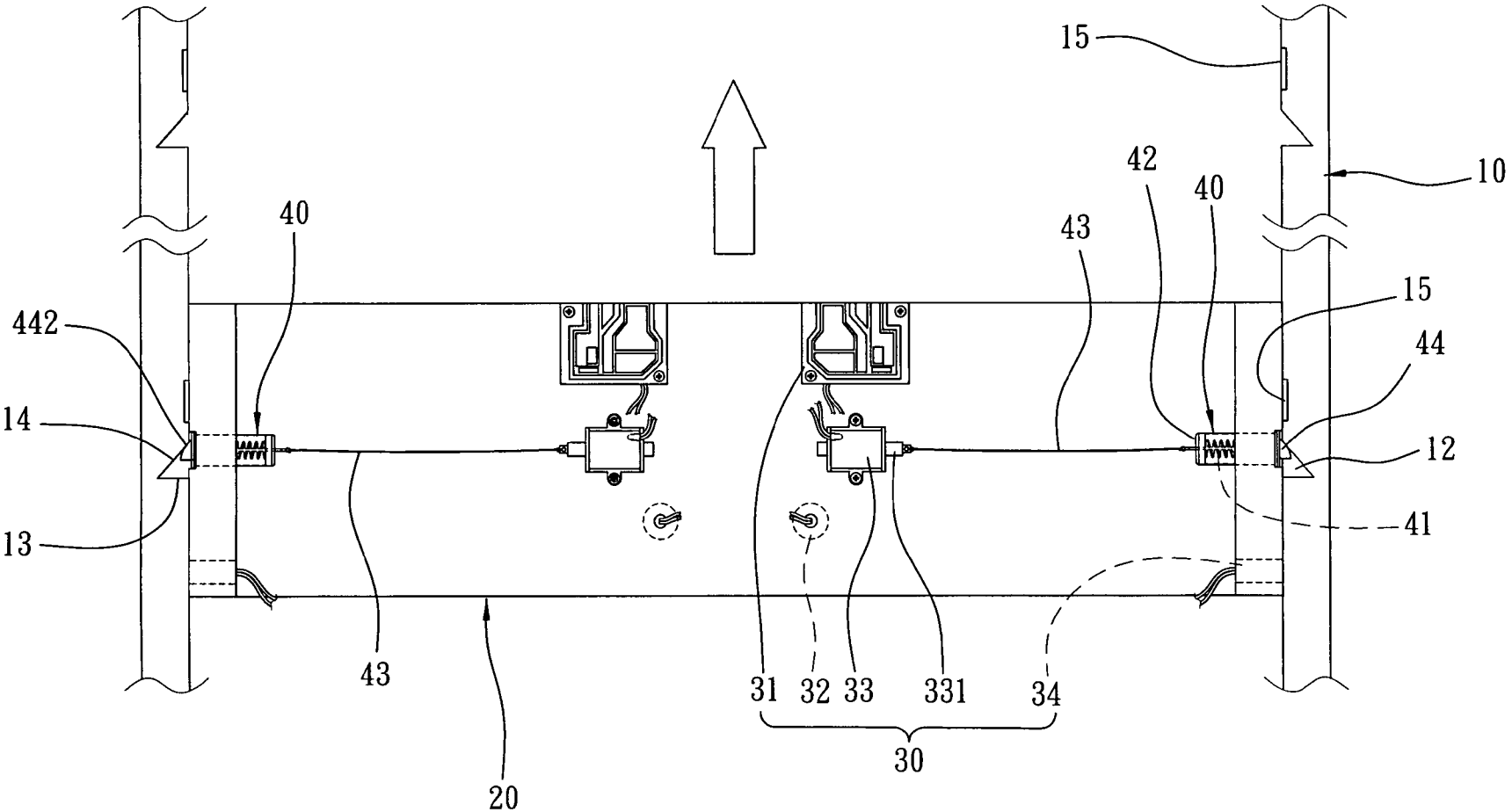
FIG. 4 is a plan view showing the state of climbing up the stairs in accordance with the first embodiment of the present invention.

Referring to FIG. 3, when climbing up the stairs A, the upper body of the user bends over the assist member 20, the assist member 20 is engaged in the positioning portions 12 of the slide rails 10 by the engaging surfaces 441 of the engaging portions 44 of the positioning assemblies 40, so as to prevent the assist member 20 from sliding out of the slide rails 10. When the user pushes the assist member 20 and moves upwardly as shown in FIG. 4, the top surfaces 14 of the positioning portions 12 will push the sliding surfaces 442 of the engaging portions 44 to move into the positioning assemblies 40 and cause compression of the springs 41, which allows the assist member 20 to slide in the slide rails 10 freely, such that the user can push the assist member 20 easily and move upwardly.

Figure 5:
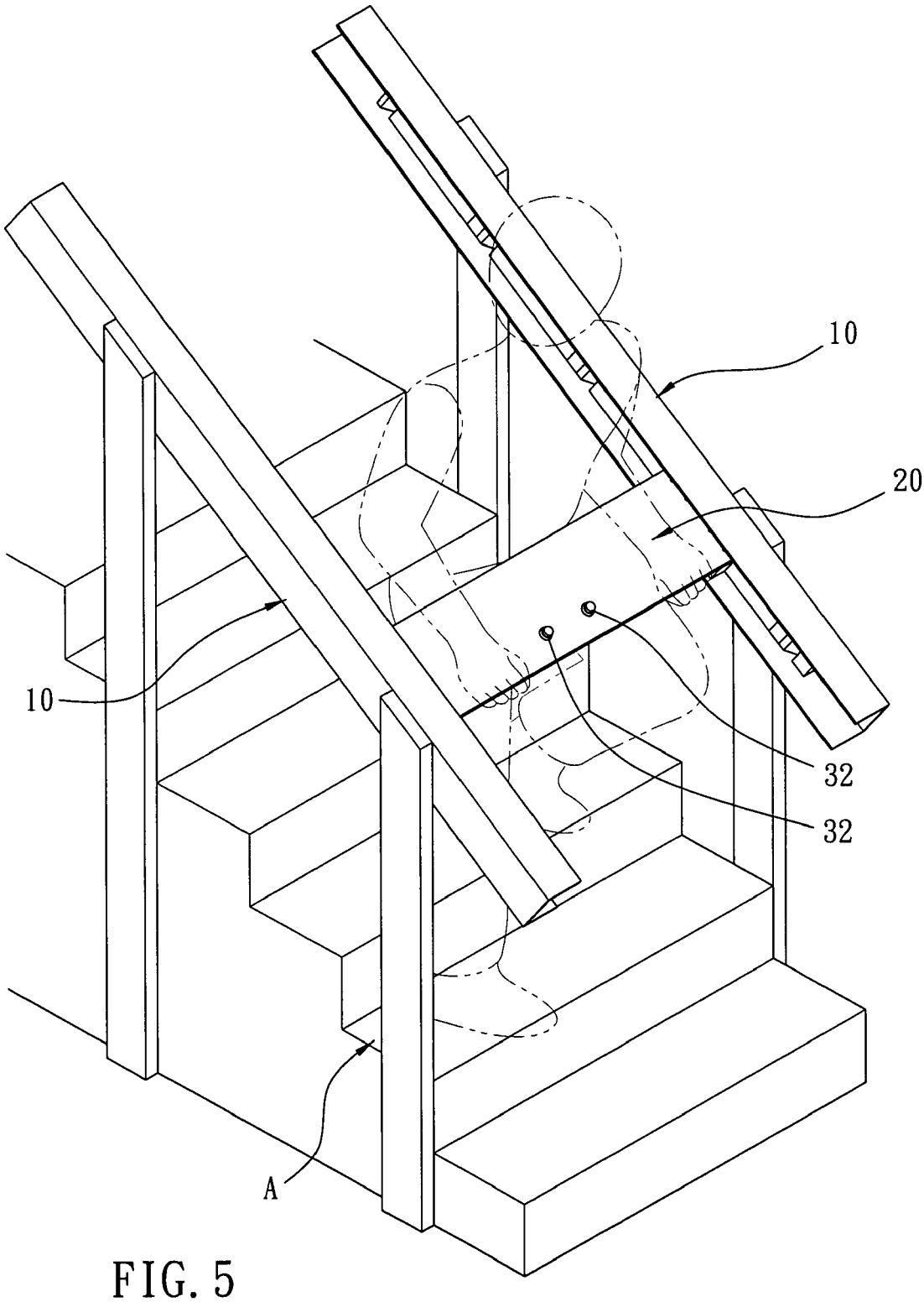
FIG. 5 is an illustrative view showing a state of climbing down the stairs in accordance with the first embodiment of the present invention.
Figure 6:
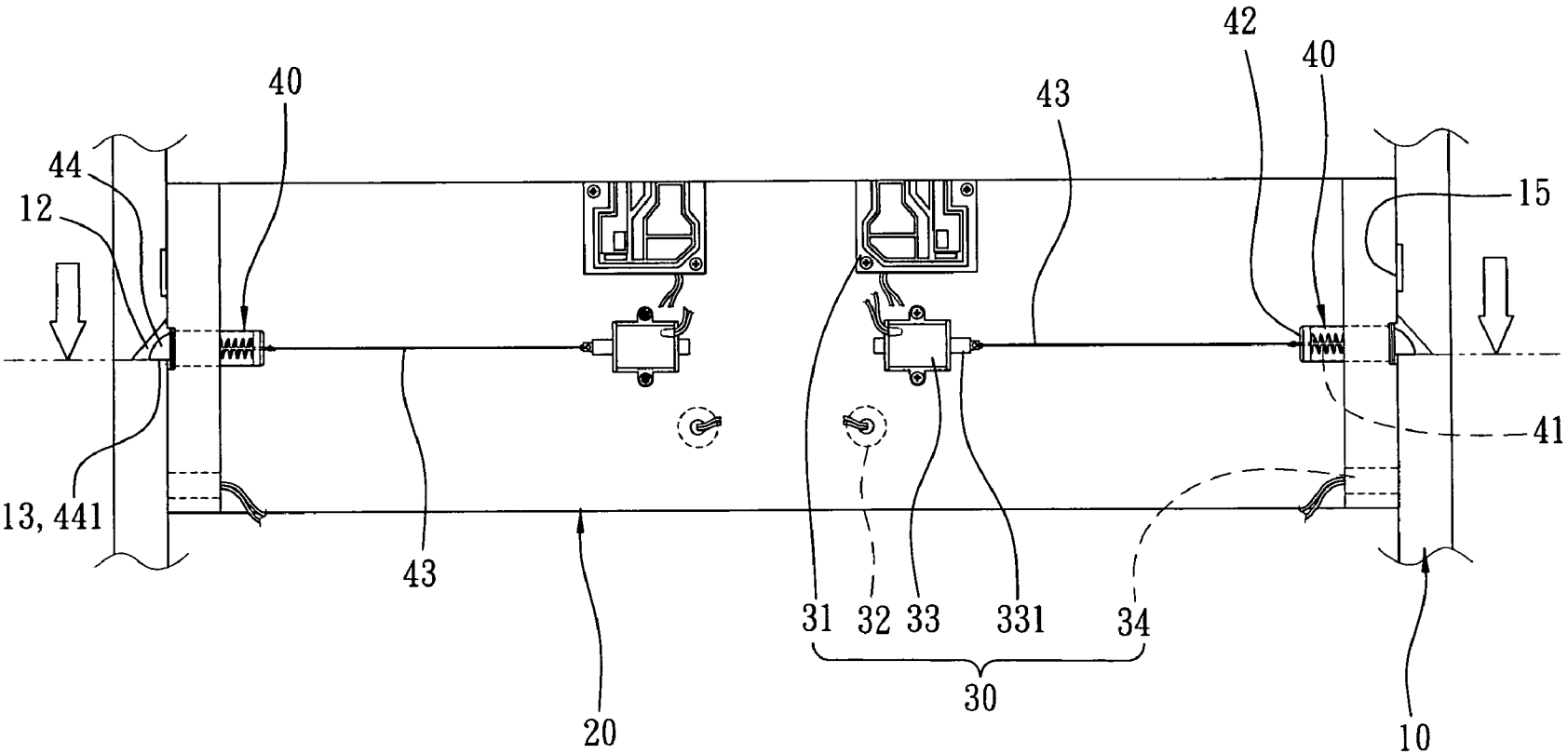
FIG. 6 is a plan view showing the state of climbing down the stairs in accordance with the first embodiment of the present invention.
Figure 7:
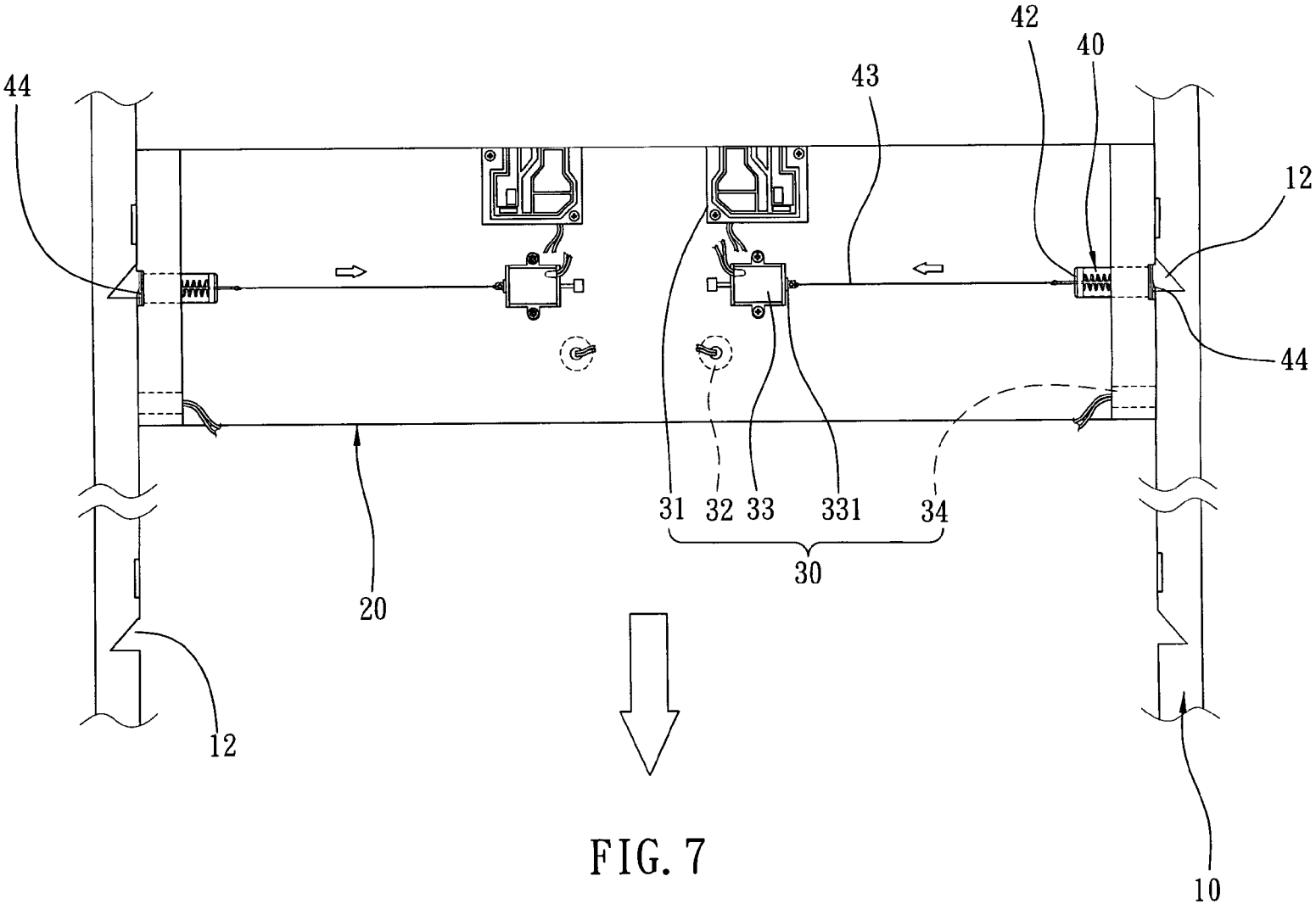
FIG. 7 is a plan view showing engaging portions move into positioning assemblies when climbing down the stairs.
Figure 8:
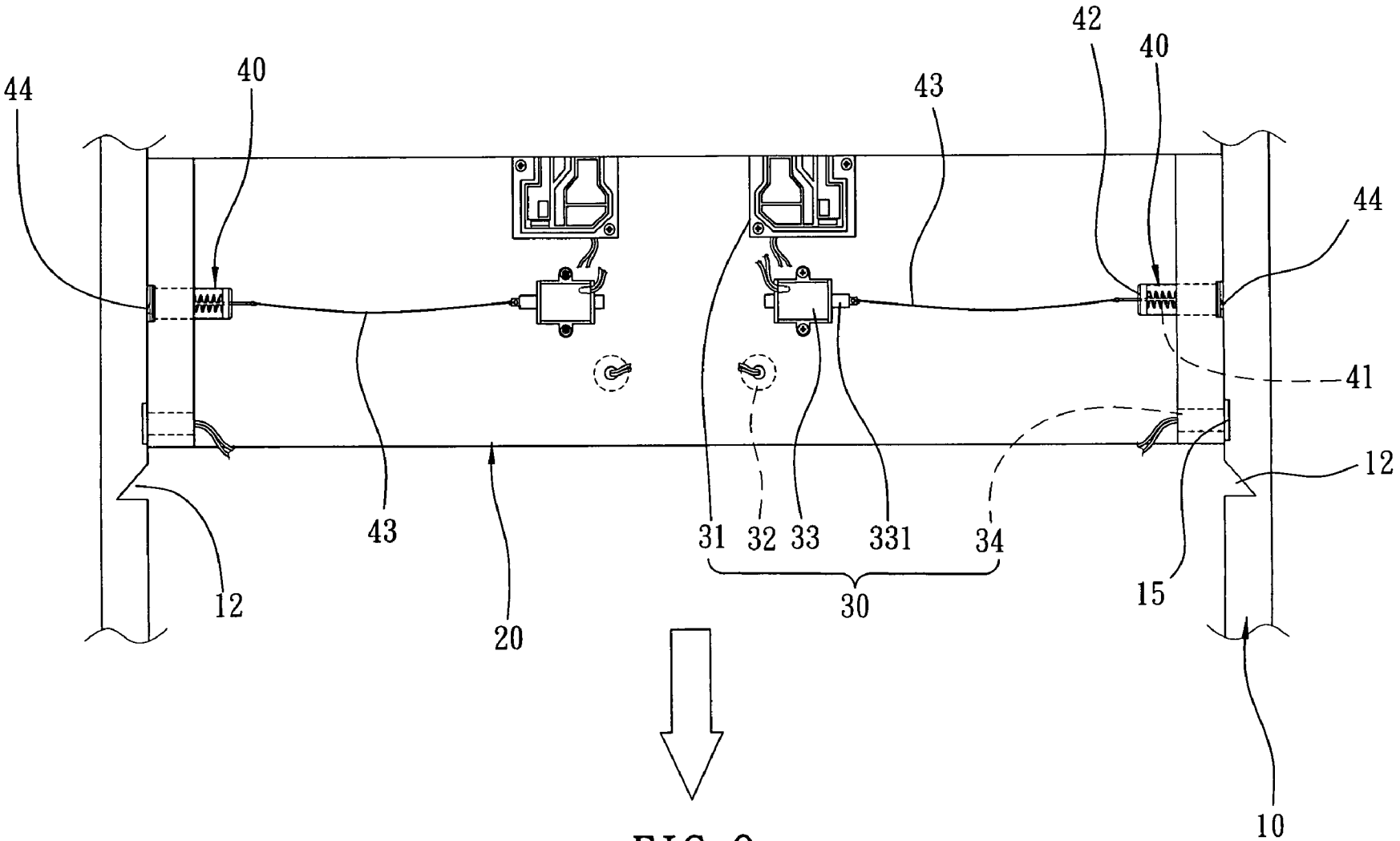
FIG. 8 is a plan view showing the state of climbing down the stairs in accordance with the first embodiment of the present invention.

Referring to FIG. 5, when climbing down the stairs A, the user presses the buttons 32 of the control mechanism 30 disposed on the assist member 20, the buttons 32 will instruct the control circuits 31 electrify the electro-magnets 33 to move the driving rods 331 into the electro-magnets 33 as shown in FIG. 6, so as to pull the connecting members 43 and the connecting portions 42, thus driving the engaging portions 44 to move into the positioning assemblies 40 and cause compression of the springs 41. Thereby, the positioning assemblies 40 disposed at both sides of the assist member 20 will be disengaged from the positioning portions 12 to allow the assist member 20 to slide in the slide rails 10, thus allowing the user to push the assist member 20 and move downwardly as shown in FIG. 7. When the assist member 20 is pushed to slide in the slide rails 10, and the sensors 34 sense the induction members 15 as shown in FIG. 8, the sensors 34 will instruct the control circuits 31 stop supplying current to the electro-magnets 33, so as to make the driving rods 331 extend out of the electro-magnets 33 again to release the engaging portions 44 of the positioning assemblies 40, such that the engaging portions 44 will be pushed by the springs 41 to protrude out of the positioning assemblies 40. When the assist member 20 moves to the position where the engaging portions 44 are engaged with the positioning portions 12 as shown in FIG. 8, the engaging surfaces 441 of the engaging portions 44 will be engaged in the positioning portions 12 and positioned on the bottom surfaces 13, such that the assist member 20 can be positioned between the slide rails 10, thus allowing the user to lean on the assist member 20 to prevent the user from falling down the stairs A. Then, by pressing the control mechanism 30 again, the user can move a further distance.

Figure 9:
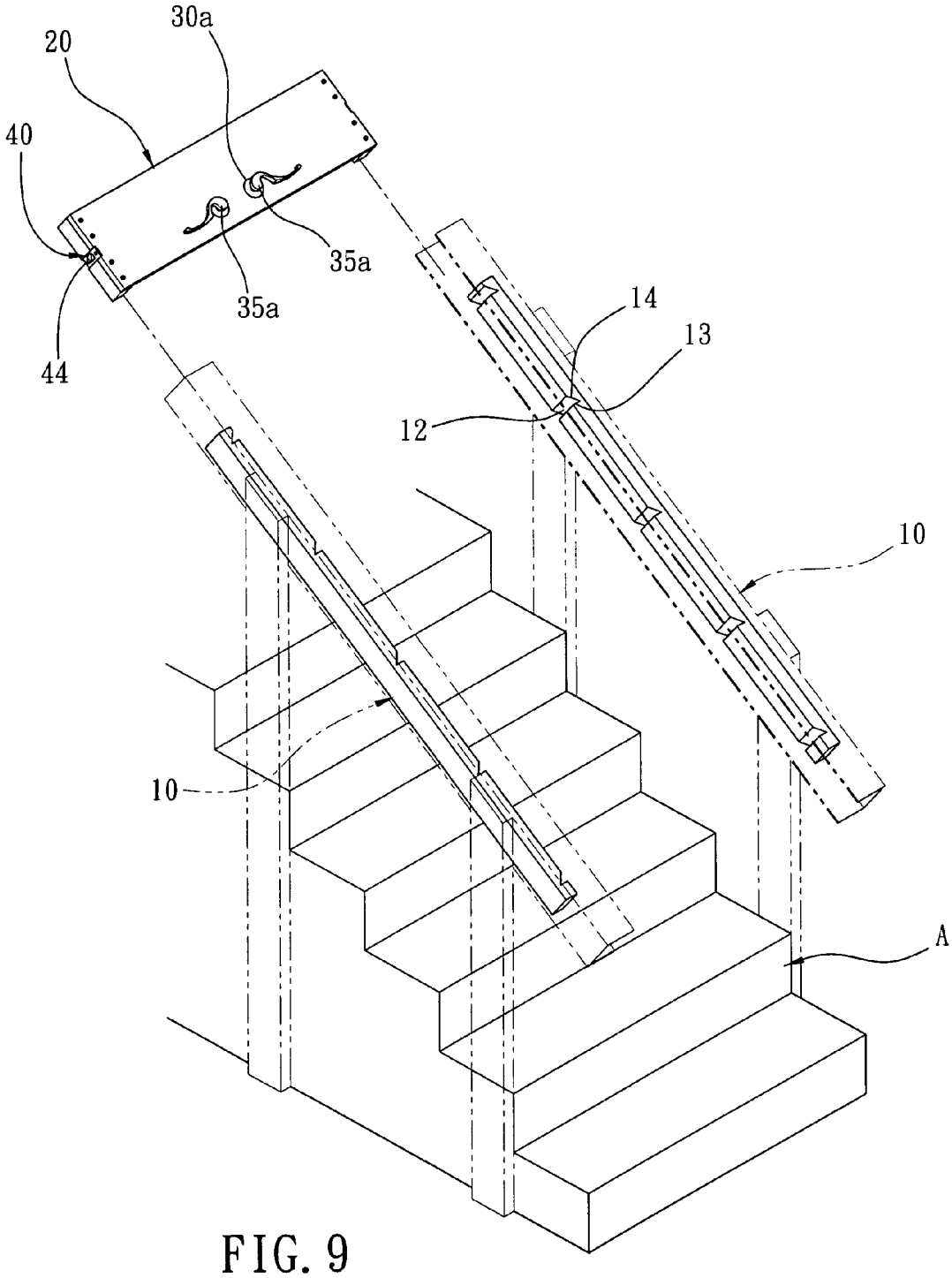
FIG. 9 is a perspective view of a stair climbing aid in accordance with a second embodiment of the present invention.
Figure 10:
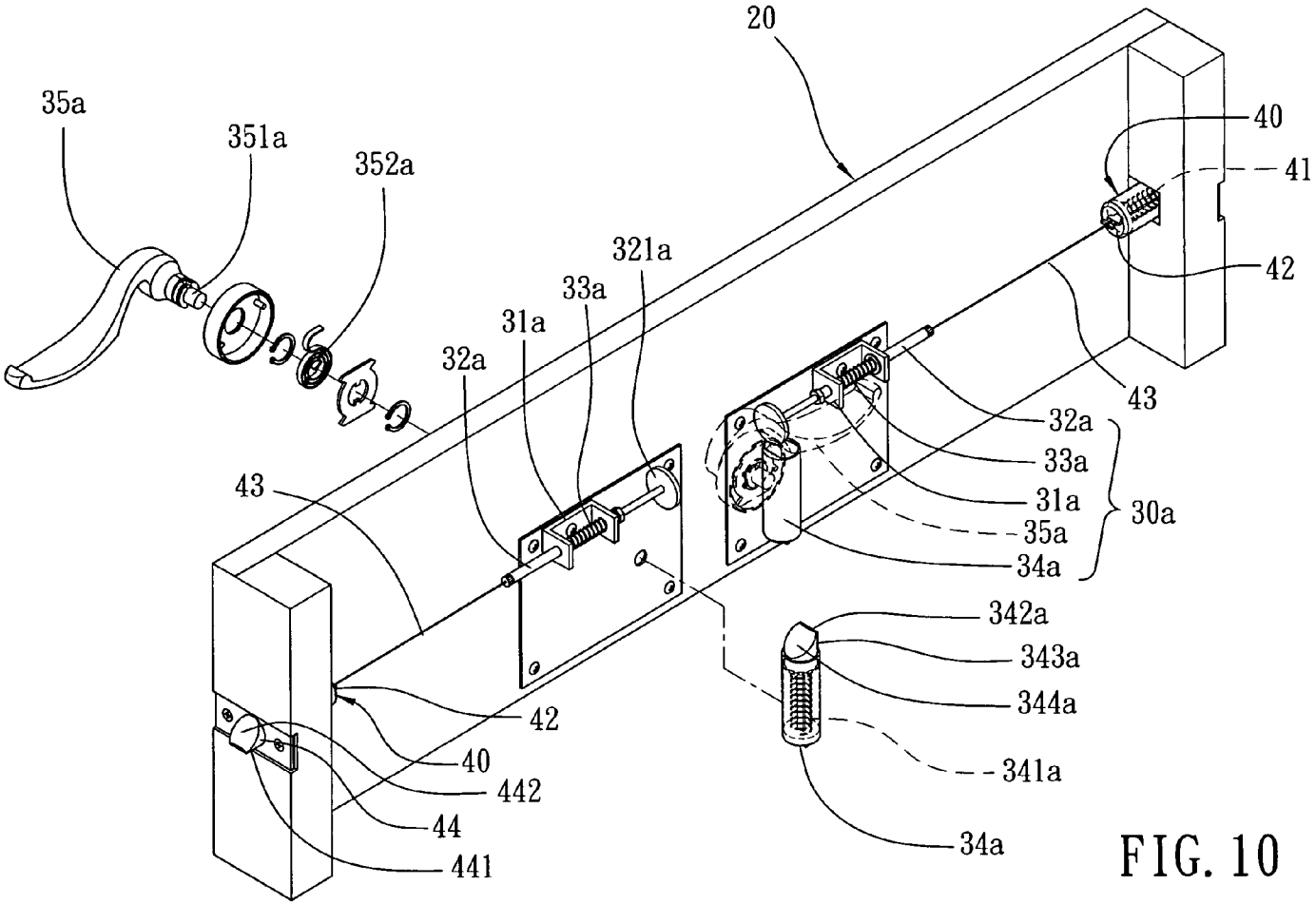
FIG. 10 is a perspective view of the assist member and the control mechanism in accordance with the second embodiment of the present invention.

In addition to the electrical control design of the control mechanism 30 as shown in FIGS. 1-8, the control mechanism 30 can also be controlled by a non-electrical means as shown in FIGS. 9-14. Referring to FIGS. 9 and 10, a control mechanism 30*a* is disposed on the assist member 20 and comprises two positioning seats 31*a*, two couple shafts 32*a*, two springs 33*a*, two linking assemblies 34*a* and two control handles 35*a*, and all the members of the control mechanism 30*a* are symmetrically disposed. The positioning seat 31*a* is U-shaped and is provided with its corresponding couple shaft 32*a* and spring 33*a*. The couple shaft 32*a* is inserted into the positioning seat 31*a*, and the spring 33*a* is mounted on the couple shaft 32*a*. Such arrangements allow the couple shaft 32*a* to move in one direction only, and the couple shaft 32*a* will be repositioned by the spring 33*a*. One end of the couple shaft 32*a* is provided with a blocking piece 321*a*, and the other end of the couple shaft 32*a* is connected to the connecting member 43 to control the engaging portion 44. An elastic member 341*a* is disposed in the linking assembly 34*a*, and an end of the elastic member 341*a* is provided with a locking tongue 342*a* having a pushing surface 343*a* and a sliding surface 344*a*. The control handle 35*a* is fixed on one side of the assist member 20 by a connecting shaft 351*a* and located at a position adjacent to its corresponding couple shaft 32*a*, an elastic piece 352*a* is mounted on the connecting shaft 351*a*, and the connecting shaft 351*a* is inserted into the other side of the assist member 20 to connect to the linking assembly 34*a*. The control handle 35*a* controls the rotation of its corresponding linking assembly 34*a*, and the locking tongue 342*a* of the linking assembly 34*a* is located corresponding to the blocking piece 321*a*.

Figure 11:
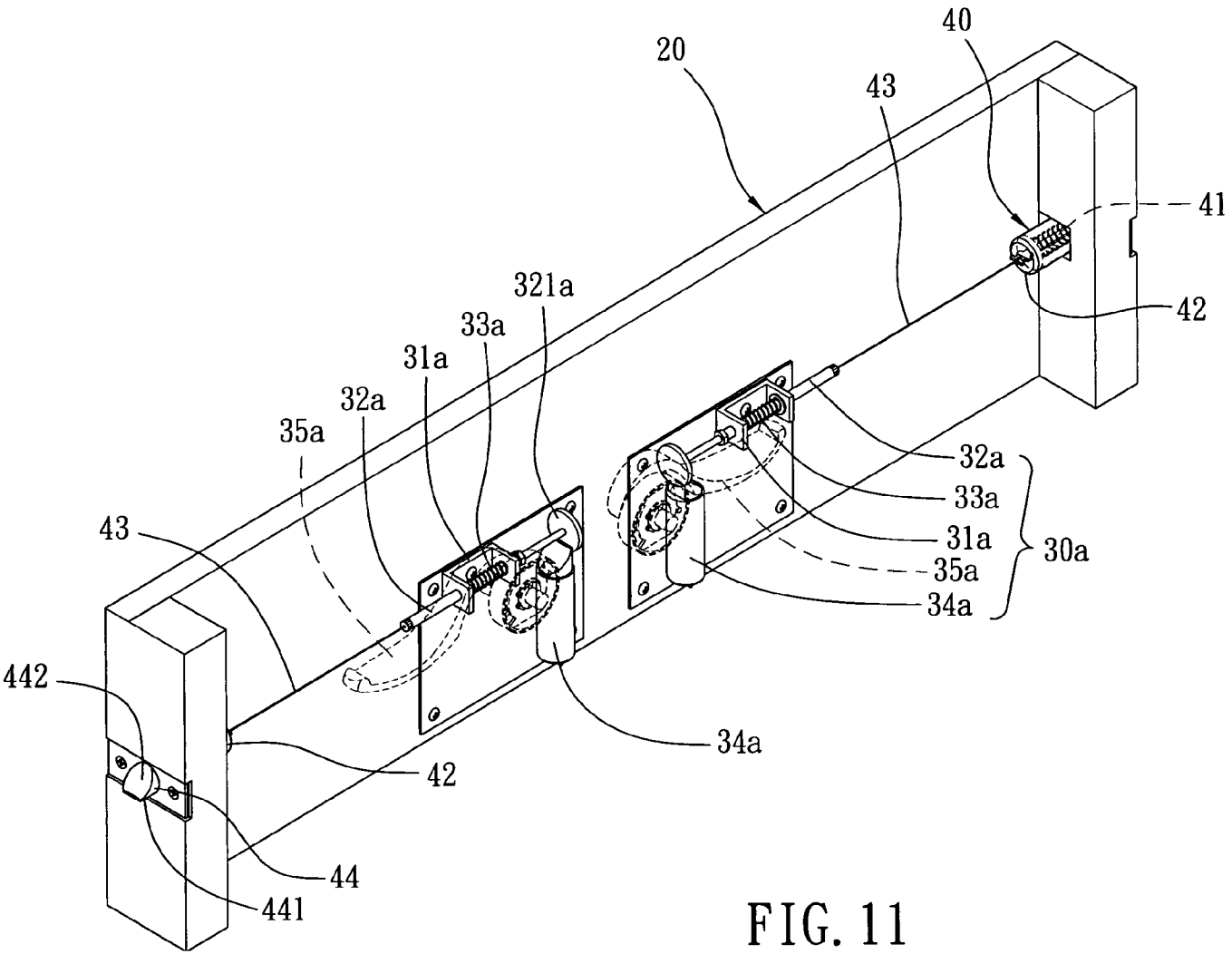
FIG. 11 is an assembly perspective view of the assist member and the control mechanism in accordance with the second embodiment of the present invention.
Figure 12:
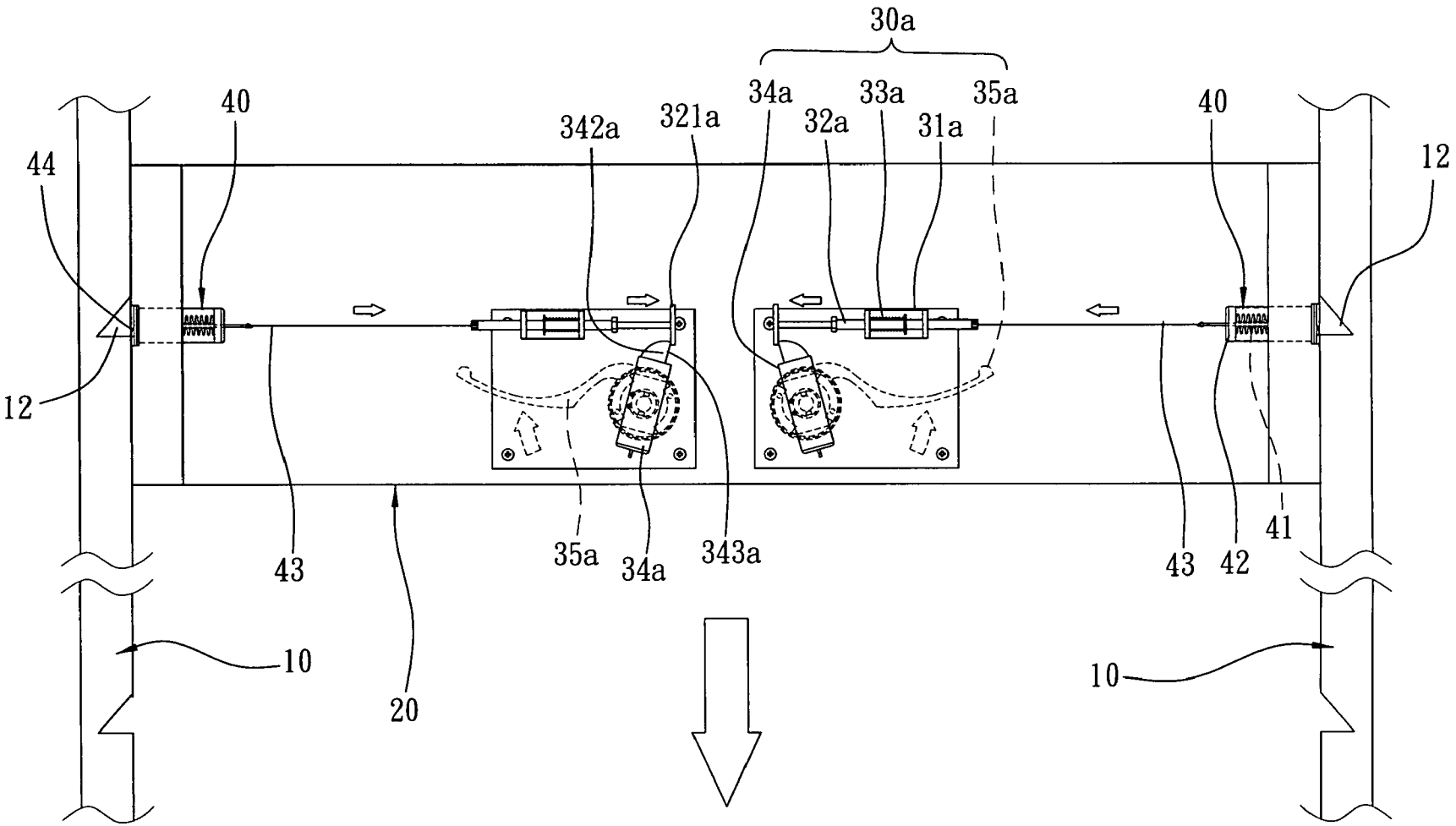
FIG. 12 is a plan view showing the engaging portions move into the positioning assemblies when climbing down the stairs.
Figure 13:
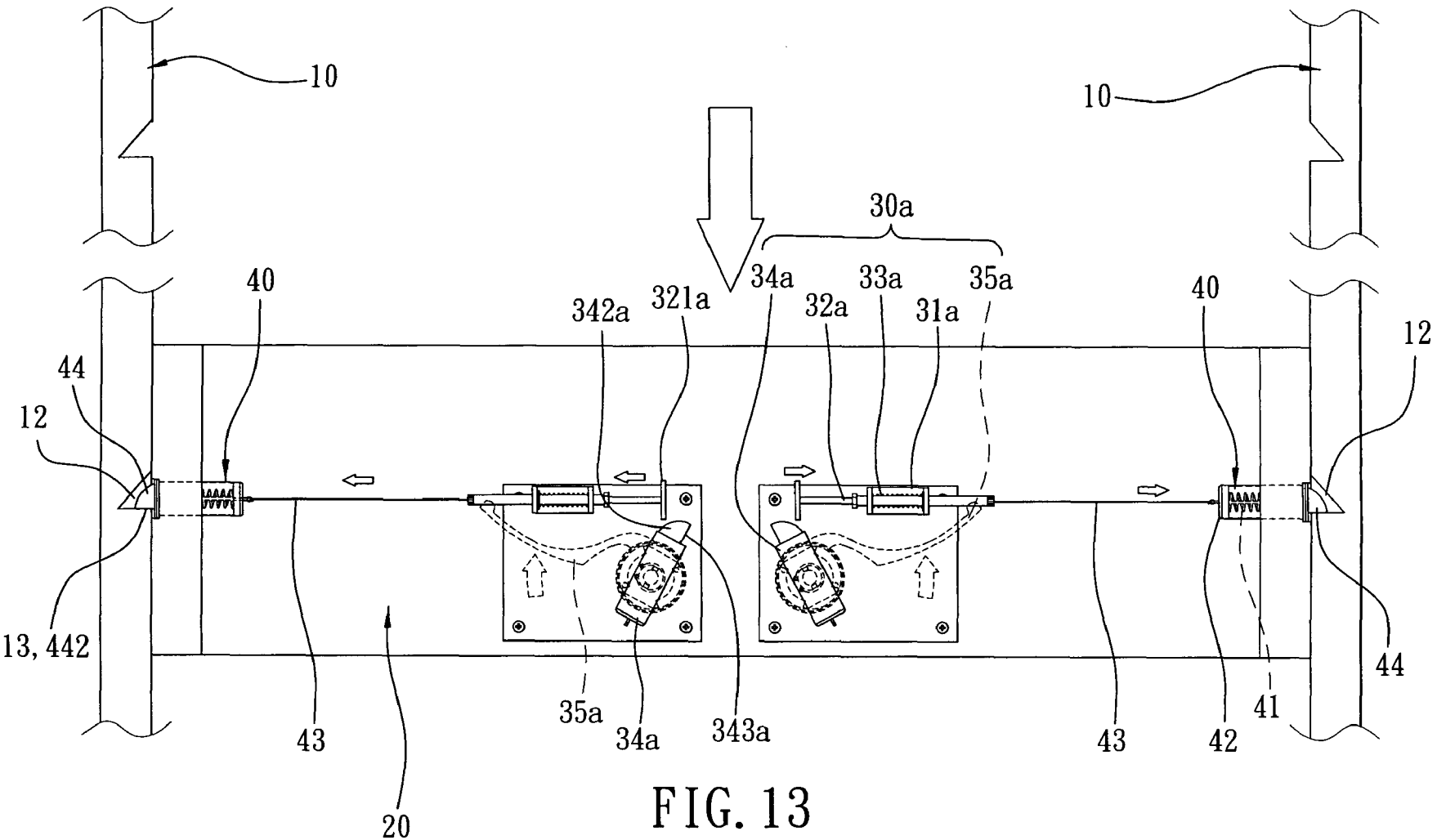
FIG. 13 is a plan view showing couple shafts being pushed by springs when climbing down the stairs.
Figure 14:
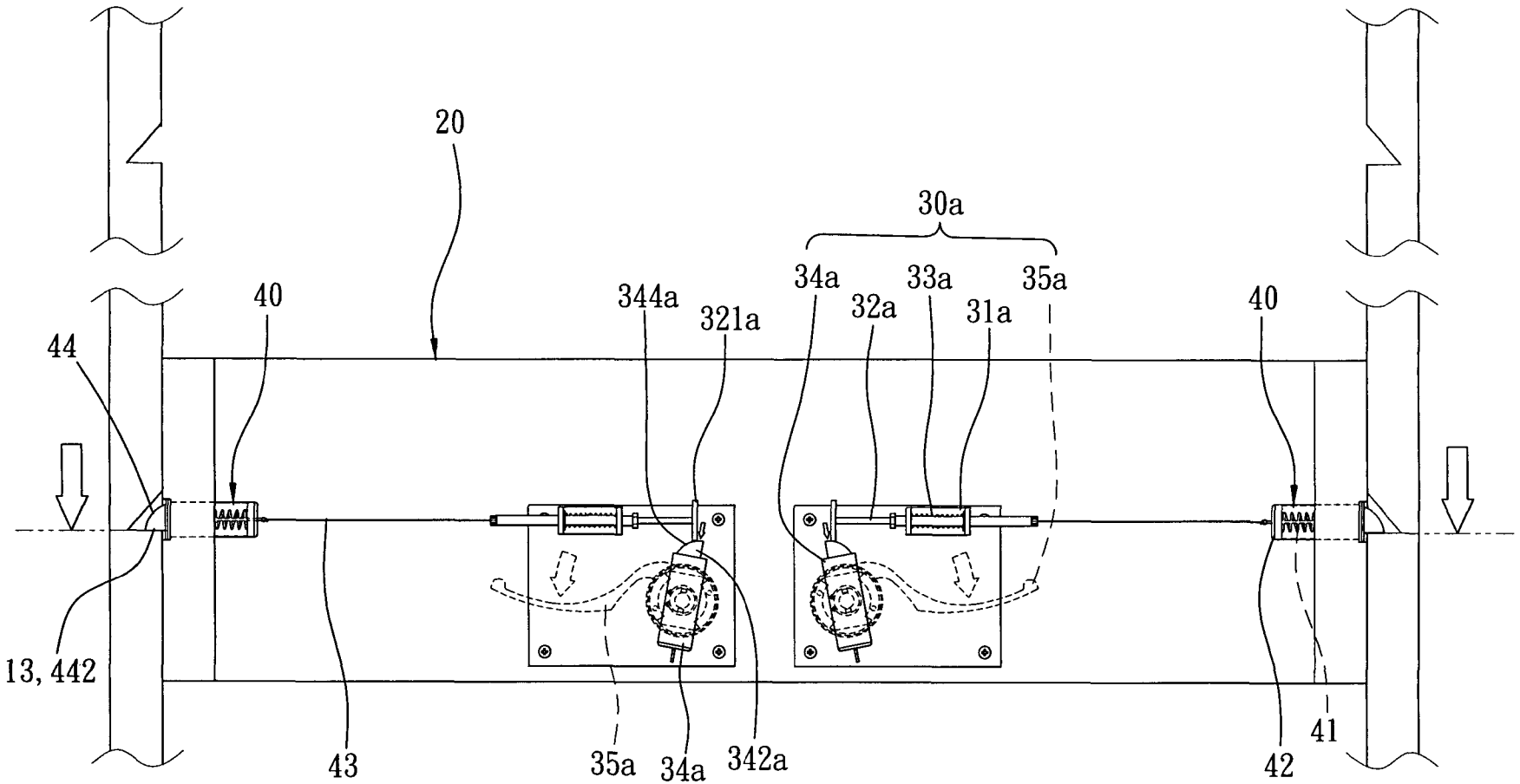
FIG. 14 is a plan view showing linking assemblies being pushed by elastic members to protrude out of blocking pieces again in accordance with the second embodiment of the present invention.

Referring to FIGS. 11 and 12, when climbing down the stairs A, the user rotates the control handles 35*a* disposed on the assist member 20, the control handles 35*a* will drive the linking assemblies 34*a* to rotate, and then the linking assemblies 34*a* use the pushing surfaces 343*a* of the locking tongues 342*a* to push the blocking pieces 321*a*, so as to pull the couple shafts 32*a* and cause compression of the springs 33*a*. Simultaneously, the couple shafts 32*a* will pull the connecting members 43 and the connecting portions 42, thus driving the engaging portions 44 to move into the positioning assemblies 40 and cause compression of the springs 41. Thereby, the positioning assemblies 40 disposed at both sides of the assist member 20 will be disengaged from the positioning portions 12 to allow the assist member 20 to slide in the slide rails 10, thus allowing the user to push the assist member 20 and move downwardly. When the control handles 35*a* are rotated exceeding a predetermined radian, the locking tongues 342*a* will not contact the blocking pieces 321*a*, and the couple shafts 32*a* will be pushed by the springs 33*a* as shown in FIG. 13. Thereby, the engaging portions 44 will be pushed by the springs 41 to protrude out of the positioning assemblies 40. When the assist member 20 moves to the position where the engaging portions 44 are engaged with the positioning portions 12, the engaging surfaces 441 of the engaging portions 44 will be engaged in the positioning portions 12 and positioned on the bottom surfaces 13, such that the assist member 20 can be positioned between the slide rails 10, thus allowing the user to lean on the assist member 20 to prevent the user from falling down the stairs A. After each time the user rotates the control handles 35*a* and releases it, the elastic pieces 352*a* will push the control handles 35*a* to rotate back to their original positions. When the locking tongues 342*a* pass through the blocking pieces 321*a*, the sliding surfaces 344*a* of the locking tongues 342*a* will be blocked and pushed by the blocking pieces 321*a* to move the locking tongues 342*a* into the blocking pieces 321*a*, so as to make the control handles 35*a* rotate back to their original positions. In addition, the locking tongues 342*a* will be pushed by the elastic members 341*a* to protrude out of the blocking pieces 321*a* again, and the engaging portions 44 will also be pushed by the springs 41 to protrude out of the positioning assemblies 40 as shown in FIG. 14.

With the above-mentioned structures, the stair climbing aid of the present invention can assist the user in climbing up and down stairs. The assist member 20 is engaged in the stairs A, so an anti-slide effect is produced, so as to prevent the user from falling down the stairs A and to help the user move from step to step safely.

While we have shown and described various embodiments in accordance with the present invention, it should be clear to those skilled in the art that further embodiments may be made without departing from the scope of the present invention.

What is claimed is:

1. A stair climbing aid being assembled to stairs, comprising:

two slide rails assembled to both sides of the stairs, each slide rail defined with a slide groove and provided with a plurality of positioning portions;

an assist member, both ends of which are slidably received in the slide grooves of the slide rails respectively;

a control mechanism disposed on the assist member; and two positioning assemblies connected to the control mechanism and disposed at both sides of the assist member respectively, each positioning assembly is provided with a spring, a connecting portion and an engaging portion, the spring is biased between the connecting portion and the engaging portion, the engaging portion is pushed by the spring to protrude out of one side of the assist member and connected to the control mechanism by a connecting member, the engaging portions of the positioning assemblies respectively cooperate with the positioning portions of the slide rails;

wherein a plurality of induction members, each disposed on a respective said slide rail, are respectively fixed adjacent to each positioning portion, and the control mechanism comprises a first and second control circuit, a first and second button, a first and second electro-magnet and a first and second sensor, wherein the first- -circuit, -button, -electro-magnet, and -sensor are symmetrically disposed with respect to the second- -circuit, -button, -electro-magnet and -sensor on each side of the assist member respectively, the buttons are connected to the control circuits respectively, each one of the electro-magnets is inserted with a respective driving rod, the sensors cooperate with the induction members of the slide rails to carry out a sensing operation, the control circuits are connected to a power source and each control circuit is electrically connected to its corresponding electro-magnet and sensor, and the driving rods are respectively connected to the positioning assemblies.

2. The stair climbing aid as claimed in claim 1, wherein the slide grooves are defined in inner sides of the slide rails and are opposite to each other.

3. The stair climbing aid as claimed in claim 1, wherein each positioning portion of the slide rail is angularly-shaped, and is formed with a bottom surface and a top surface.

4. The stair climbing aid as claimed in claim 1, wherein the engaging portion of each positioning assembly is angularly-shaped, and comprises an engaging surface and a sliding surface.

* * * * *